United States Patent [19]

Kuroda et al.

[11] Patent Number: 4,473,996

[45] Date of Patent: Oct. 2, 1984

[54] POLYESTER CONJUGATE CRIMPED YARNS

[75] Inventors: Toshimasa Kuroda, Osaka; Seiji Ishii, Ehime; Tatsuya Shibata, Osaka, all of Japan

[73] Assignee: Teijin Ltd., Osaka, Japan

[21] Appl. No.: 399,148

[22] Filed: Jul. 16, 1982

[30] Foreign Application Priority Data

Jul. 17, 1981 [JP] Japan ..... 56-110802
Sep. 10, 1981 [JP] Japan ..... 56-141630

[51] Int. Cl.[3] ..... D02G 3/00; D01F 8/14

[52] U.S. Cl. ..... 57/245; 57/905; 428/370

[58] Field of Search ..... 428/264, 270, 370, 374, 428/392, 394, 395; 57/243–247, 905

[56] References Cited

U.S. PATENT DOCUMENTS

| | | | |
|---|---|---|---|
| 4,019,311 | 4/1977 | Schippers | 57/905 X |
| 4,060,968 | 12/1977 | Barbe et al. | 57/905 X |
| 4,117,194 | 9/1978 | Barbe et al. | 428/370 X |
| 4,217,321 | 8/1980 | Campbell | 428/370 X |

FOREIGN PATENT DOCUMENTS

| | | | |
|---|---|---|---|
| 2008153 | 1/1977 | Japan | 57/905 |

*Primary Examiner*—Donald Watkins
*Attorney, Agent, or Firm*—Sughrue, Mion, Zinn, Macpeak & Seas

[57] ABSTRACT

Polyester conjugate crimped yarns prepared by conjugate spinning (1) an A component substantially comprising polybutylene terephthalate and (2) a B component substantially comprising polyethylene terephthalate at a weight ratio of 30:70 to 70:30 in a side-by-side or eccentric sheath-core arrangement, rendered crimpable by false twisting to a degree of crimpability $TC_{10}$ of 8% or more when subjected to a boiling water treatment under a load of 10 mg/de. The polyester conjugate crimped yarn can be obtained by subjecting the conjugate yarn to single-heater false twisting under the conditions which satisfy the following relations:

$$TW \geqq 24380/\sqrt{De} \quad \text{(i)}$$

$$185 + 50\,[\eta]B \geqq T \geqq 150 \quad \text{(ii)}$$

where

TW is the number of false twists (T/m);

De is the total denier of the yarn after false twisting;

T is the temperature in 0° C. of the false twister heater;

$[\eta]B$ is the intrinsic viscosity of the B component.

Stretch woven fabrics having a stretch percentage of 15% or more can be obtained by weaving the above-mentioned polyester conjugate crimped yarns.

4 Claims, 3 Drawing Figures

POLYESTER CONJUGATE CRIMPED YARNS

FIELD OF THE INVENTION

The present invention relates to polyester conjugate crimped yarns which have excellent crimpability and are suited for preparing stretch fabrics, processes for the preparation thereof, and stretch fabrics obtained by weaving the crimped yarns.

BACKGROUND OF THE INVENTION

In recent years, various functional characteristics have been increasingly demanded of woven and knitted fabrics and, above all, the demand for stretchability of fabrics has markedly increased. The reason for this active demand may be attributed to the fact that the elastic quality of woven and knitted clothing actively influences the delicate relationship between a comfortable feel and tightness during movement. More particularly, a marked advantage of woven and knitted clothing with good elastic quality is that no feeling of tightness arises since the elasticity allows such clothing to fit snugly, even with body action. Another unique advantage of elastic clothing is found in its crease resistant property.

Where it is desired to provide woven and knitted fabrics with stretchability, knitted fabrics can be made stretchable with comparative ease by use of ordinary false twisted yarns because of their loose structure. However, woven fabrics with satisfactory stretchability cannot be obtained by use of ordinary false twisted yarns since woven fabrics have a rigid structure as compared with knitted fabrics. However, since woven fabrics have their own excellent characteristics different from those of knitted fabrics in touch, luster, etc., it has been strongly desired to make stretch woven fabrics which preserve these characteristics inherent in woven fabrics.

Many proposals have hitherto been advanced for the enhancement of the stretchability of woven fabrics to meet the requirements mentioned above. For instance, methods have been adopted to partially introduce elastic yarns made of stretchable materials such as urethane, rubber, etc. into the fabrics. However, the use of urethane, rubber, and the like increases the cost of the fabrics and since these materials stretch too much, none of them can be used by themselves. They must be wrapped with a twisted yarn of low stretch for stretchability control. A disadvantage is then found with the use of a twisted yarn in that the production cost of the woven fabric is increased since a very inefficient and complicated process is involved in making a twisted yarn.

Several methods have been proposed to obtain a crimped yarn from a conjugate filament consisting of different polyester components.

For instance, Japanese Patent Publication No. 19108/68 discloses that a conjugate filament, which is obtained by conjugate spinning polybutylene terephthalate and polyethylene terephthalate in an eccentric sheath-core or side-by-side arrangement, can be crimped due to the potential thermal crimpability existing between the two components. However, a crimped filament prepared by simply subjecting this conjugate filament to drawing and thermal relaxation treatments can never be used to produce such a highly crimped filament that is prepared by subjecting the conjugate filament to a boiling water treatment under high load.

Also, Japanese Patent Application Laid-Open No. 84924/76 discloses a conjugate filament consisting of polybutylene terephthalate and polyethylene terephthalate, with the difference of intrinsic viscosity between the two components being defined. This conjugate filament not only fails to provide a stretch fabric with excellent elasticity but also other difficult problems arise including the development of dyeing specks due to the uneven heat setting which occurs at the time of the thermal relaxation treatment and the formation of tight picks in the woven fabric arising from high shrinkage of yarns occurring during the thermal relaxation treatment. This makes it difficult to produce stretch woven fabrics of good marketability.

Furthermore, Japanese Patent Application Laid-Open No. 67421/76 discloses a process whereby a conjugate filament made of polybutylene terephthalate and polyethylene terephthalate in a side-by-side or eccentric sheath-core arrangement is subjected to a 2-heater false twisting process. However, in this 2-heater false twisting process in which the conjugate filament is subjected to a thermal relaxation treatment after false twisting, the crimpability obtained in a boiling water treatment under high load decreases. Thus, it is impossible to obtain a crimped yarn maintaining the high crimpability which arises from a boiling water treatment under high load.

SUMMARY OF THE INVENTION

A main object of the present invention is to provide a crimped yarn having high crimpability obtained in a boiling water treatment under high load and a stretch fabric prepared from the thus-obtained crimped yarn at a lower cost.

Other objects and advantages of the present invention will be apparent from the following description.

Accordingly, in one embodiment the present invention provides polyester conjugate crimped, filaments which are characterized by a structure which comprises:

(1) an A component substantially comprising polybutylene terephthalate, and (2) a B component substantially comprising polyethylene terephthalate at a ratio of A component to B component of 30:70 to 70:30% by weight in a side-by-side or eccentric sheath-core arrangement, rendered crimpable by false twisting, and having a degree of crimpability $TC_{10}$ produced by a boiling water treatment under a load of 10 mg/de of 8% or more.

Another embodiment of the present invention is to provide a process for the preparation of a conjugate crimped filament comprising:

conjugate spinning a filament from (1) an A component substantially comprising polybutylene terephthalate and (2) a B component, whose intrinsic viscosity $[\eta]B$ is 0.55 or less, substantially comprising polyethylene terephthalate, at a ratio of A component to B component of 30:70 to 70:30% by weight in a side-by-side or eccentric sheath-core arrangement, and subjecting the thus-obtained conjugate filament to a single heater false twisting process under the conditions which satisfy the following relationships:

$$TW\sqrt{24380/\sqrt{De}} \quad \text{(i)}$$

$$185+50[\eta]B \geqq T \geqq 150 \quad \text{(ii)}$$

where

TW is the number of false twists (T/m);

De is the total denier of the yarn after false twisting;

T is the temperature in °C. of the false twister heater; and $[\eta]B$ is the intrinsic viscosity of the B component.

A further embodiment of the present invention is to provide a polyester stretch fabric, which has a stretch percentage of 15% or more, woven from polyester conjugate crimped yarns obtained by conjugate spinning filaments of (1) an A component substantially comprising polybutylene terephthalate and (2) a B component substantially comprising polyethylene terephthalate at a ratio of A component to B component of 30:70 to 70:30% by weight in a side-by-side or eccentric sheath-core arrangement, p rendering the filaments crimpable by false twisting into a yarn, and having a degree of crimpability $TC_{10}$ produced by a boiling water treatment under a load of 10 mg/de of 8% or more; and weaving the yarn into a woven fabric.

DESCRIPTION OF THE PREFERRED EMBODIMENTS

Figure 1:
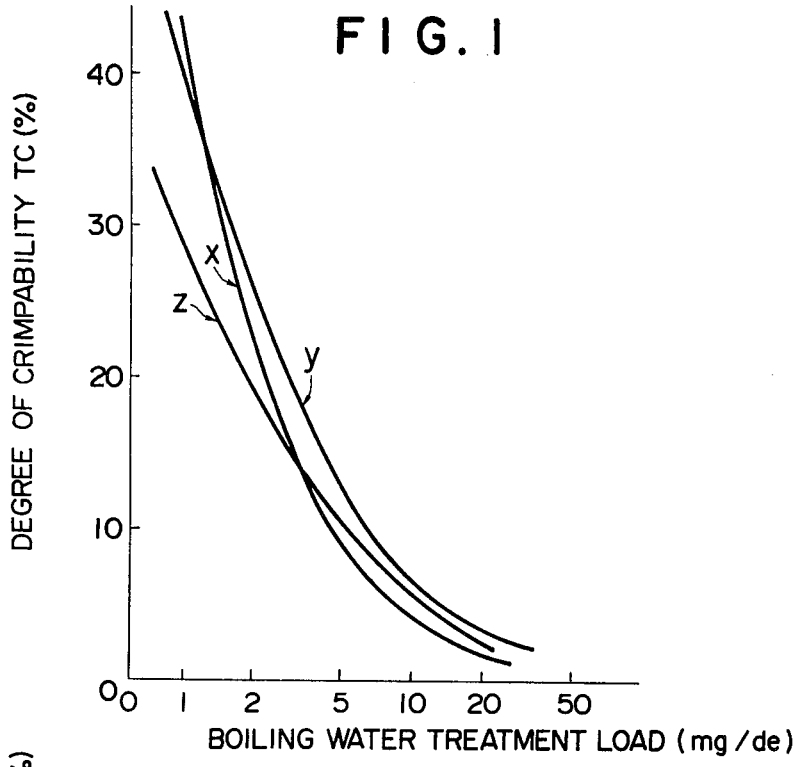
FIG. 1 is a graph to show the relationship between the degree of crimpability and the load under which the crimped yarns are subjected to a boiling water treatment.

FIG. 1 is a graph showing the relationship between the degree of crimpability and the load under which the boiling water treatments were carried out. The degrees of crimpability of the various crimped yarns were measured by changing the load under which the boiling water treatments were conducted. FIG. 1 clearly demonstrates that yarns x and y, which represent similar values of crimpability under low load, have different values of crimpability under high load, while yarn z, which represents a low value of crimpability as compared with the other yarns x and y under low load, has a high value of crimpability under high load. Thus, each yarn behaves differently from the others under different degrees of load employed in the boiling water treatment.

Based upon the above knowledge, research was continued in an effort to obtain a crimped yarn which exhibited a high value of crimpability in a boiling water treatment conducted under high load and which was suited for making a highly stretchable fabric. The research has resulted in the discovery that the desired yarn can be obtained by spinning polybutylene terephthalate and polyethylene terephthalate into a conjugate filament wherein both polymer components are arranged in a side-by-side or eccentric sheath-core relationship under specific conditions and further false twisting the thus-obtained filament under specific conditions, thus resulting in the present invention.

A very outstanding characteristic of the yarns according to the present invention is that the yarns are produced with a degree of crimpability $TC_{10}$ of 8% or more, preferably 10% or more, when subjected to a boiling water treatment under a high load, i.e., under a load of 10 mg/de.

Figure 2:
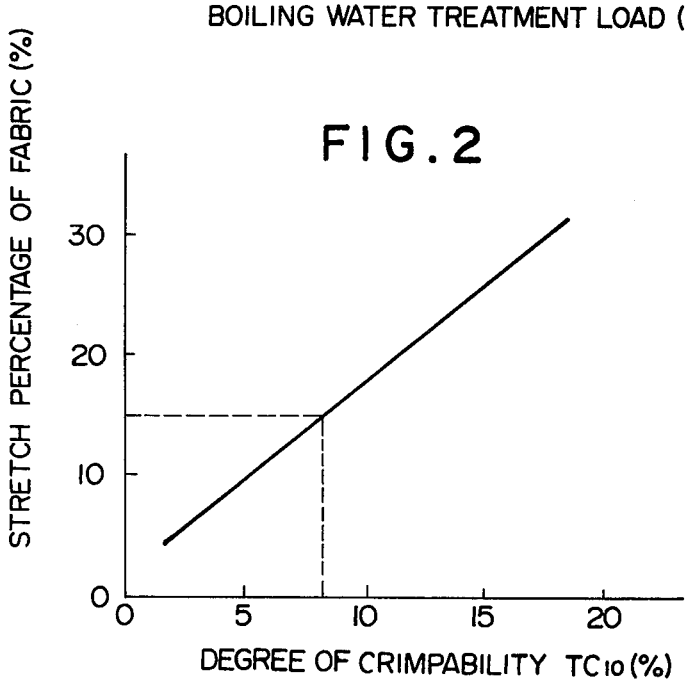
FIG. 2 is a graph to show the relationship between the degree of crimpability of the yarn obtained by a boiling water treatment under a load of 10 mg/de and the stretch percentage of the fabric woven therefrom.

FIG. 2 is a graph showing the relationship between the degree of crimpability $TC_{10}$ of the crimped yarn obtained by a boiling water treatment under a load of 10 mg/de and the stretch percentage of the fabric woven from the crimped yarn. This graph indicates that there is a close relationship between the degree of crimpability $TC_{10}$ of the crimped yarn and the stretch percentage of the fabric made therefrom. An essential requirement for the fabric is to have a stretch percentage of 15% or more for practical use as a satisfactory stretch fabric. FIG. 2 clearly shows that the yarn should have a degree of crimpability $TC_{10}$ of 8% or more, preferably 10% or more, in order to be able to produce a fabric having a stretch percentage of 15% or more.

The reason for the existence of this close relationship between the degree of crimpability $TC_{10}$ of the yarn obtained in the boiling water treatment under a high load and the stretch percentage of the fabric may be assumed to be that the shrinkage of the fabric occurring during the process of relaxation and dyeing of the grey fabric greatly influences the formation of the crimp of the yarns used to make the fabric and that when the crimp of the crimped yarn under high load is greater, a fabric having a higher stretch percentage can be obtained.

It is, therefore, necessary to obtain a crimped yarn with a degree of crimpability of $TC_{10}$ of 8% or more to use a filament which is prepared by conjugate spinning an A component substantially comprising polybutylene terephthalate and a B component substantially comprising polyethylene therephthalate at a ratio of A component to B component of 30:70 to 70:30% by weight in a side-by-side or eccentric sheath-core arrangement, wherein component B has an intrinsic viscosity $[\eta]B$ of 0.55 or less.

In the context of the present invention the A component substantially comprising polybutylene terephthalate is defined as being a polyester, where 80 mole % or more, preferably 90 mole % or more of the repeating units thereof is composed of butylene terephthalate units. A content of polybutylene terephthalate units below 80 mole %, should be avoided because a problem arises with the dyed fabric in that degradation of colorfastness against washing and weathering arises.

Also, the B component substantially comprising polyethylene terephthalate is defined as being a polyester, where 80 mole % or more, preferably 90 mole % or more, of the repeating units thereof is composed of ethylene terephthalate units. When the content of polyethylene terephthalate units is below 80 mole %, a crimped yarn, having a degree of crimpability $TC_{10}$ of 8% or more, which is an object of the present invention, cannot be obtained.

The above-described polybutylene terephthalate component A may be copolymerized with a third component, i.e., one or more dicarboxylic acids such as isophthalic acid, phthalic acid, methylterephthalic acid, adipic acid, etc., and one or more diglycols such as ethylene glycol, trimethylene glycol, neopentyl glycol, etc. at a ratio of 20 mole % or less, preferably 10 mole % or less. Also, component A may contain a small amount of another polymer, a delustering agent such as titanium oxide, calcium carbonate, etc., and any other well-known and conventionally used additives.

The polyethylene terephthalate component B may likewise be copolymerized with a third component such as one or more of the dicarboxylic acids described above and diglycols including trimethylene glycol, tetramethylene glycol, neopentyl glycol, etc., at a ratio of 20 mole % or less, preferably 10 mole % or less. Also component B may contain a small amount of another polymer, a delustering agent such as titanium oxide, calcium carbonate, etc., and any other well-known and conventionally used additives.

In conjugate spinning the A component comprising polybutylene terephthalate and the B component comprising polyethylene terephthalate in a side-by-side or eccentric sheath-core arrangement, conjugate filaments can be easily prepared by melt spinning using a conventionally known spinneret, for instance, the spinnerets as described in Japanese Patent Publication No. 19108/68 and Japanese Patent Publication No. 16125/66. Especially in obtaining a conjugate filament in a side-by-side arrangement, spinning can be carried out in a stable manner by use of a spinneret, as described in Japanese Utility Model Publication No. 19536/67 which is designed to combine both components together immediately after their extrusion from the spinneret. More particularly, when two polymers of different melt viscosities are extruded from the same orifice of the spinneret at the same ratio of extrusion, the low viscosity polymer is extruded faster than the high viscosity polymer. This causes the extruded conjugate filament to bend and stick to the surface of the spinneret which is known as kneeing. This causes the stability of the spinning process to decrease. However, the use of the spinneret described in Japanese Utility Model Publication No. 19536/67 allows both polymers to flow out of the respective orifices approximately at the same extrusion speed regardless of a difference in their melt viscosities, thus making it possible to achieve a stable spinning operation free from kneeing.

The weight ratio between the A component comprising polybutylene terephthalate and the B component comprising polyethylene terephthalate in the conjugate filament, or the extrusion ratio between the A and B components, should be so designed as to maintain the amount of the A component in the range of 30 to 70%, preferably in the range of 35 to 65% by weight, and the amount of the B component in the range of 70 to 30%, preferably in the range of 65 to 35% by weight, taking the stability of the spinning process into consideration.

When the weight ratio between the A and B components is outside the above-described range, the degree of crimpability $TC_{10}$ of the conjugate filament obtained will not be 8% or more and accordingly the stretch percentage of the fabric prepared from such filaments cannot be 15% or more.

It is not necessary to specifically limit the arrangement of the A component and the B component in conjugate spinning of filaments in an eccentric sheath-core relationship. However, it is desirable to utilize the B component comprising polyethylene terephthalate which has better color-fastness as the sheath and to utilize the A component comprising polybutylene terephthalate as the core.

A very important point in the preparation of polyester conjugate crimped filament according to the present invention is the intrinsic viscosity $[\eta]B$ of the B component which comprises polyethylene terephthalate. It is, therefore, necessary for the intrinsic viscosity $[\eta]B$ of the B component to be 0.55 or less. When the intrinsic viscosity $[\eta]B$ of the B component is 0.55 or less, a stretch filament having a high degree of crimpability $TC_{10}$ is obtained. The reason for obtaining a crimped filament of a greater degree of crimpability $TC_{10}$ in the boiling water treatment conducted under load of 10 mg/de when the intrinsic viscosity $[\eta]B$ of the B component is set to 0.55 or less is set forth hereinafter in the discussion of false twisting.

No specific limit exists as to the intrinsic viscosity $[\eta]A$ of the A component comprising polybutylene terephthalate. However, when the A component is subjected to conjugate spinning in combination with the B component comprising polyethylene terephthalate, the molecular orientation of polybutylene terepthalate of the A component is greater than the orientation effect of the molecules of polyethylene terephthalate of the B component. The properties of the A component comprising polybutylene terephthalate greatly contribute to the mechanical properties such as crimpability, stretchability, etc., of the crimped yarn after drawing or false twisting processing. Therefore, it is desirable for the intrinsic viscosity $[\eta]A$ of the A component to be 0.7 or more, preferably 0.8 or more, in order to produce the polyester conjugate crimped yarn of the present invention in the process of preparing a fabric or to have the prepared fabric maintain its mechanical properties. Thus the conjugate spun filament is wound up at a prescribed constant rate via rollers after the filament is cooled in a stream of cooling gas. Then the filament is drawn at a prescribed drawing ratio and subjected to the false twisting processing. In this case, an undrawn filament which is melt spun and wound up at a comparatively fast rate, for instance, at the rate of 2000 m/min. or higher, can be subjected to the draw texturing process. This process of draw texturing is advantageous from a cost standpoint and also has an effect of increasing the degree of crimpability $TC_{10}$. It is advisable for the elongation at break of the undrawn filament to be 60 to 200%. The respective processes of spinning, drawing, and texturing, can, of course, be carried out continuously, if desired.

A very essential requirement for the preparation of a polyester conjugate crimped yarn of the present invention is to carry out the single heater false twisting under the conditions described below:

$$TW\sqrt{24380/\sqrt{De}}$$

$$185+50[\eta]B \geqq T \geqq 150$$

where

TW is the number of false twists (T/m);

De is the total denier of the yarn after false twisting;

T is the temperature of the false twister heater (°C.);

$[\eta]B$ is the intrinsic viscosity of the B component.

According to the present invention, a crimped yarn having a degree of crimpability $TC_{10}$ of 8% or more than subjected to the boiling water treatment under high load, i.e., under a load of 10 mg/de, can be obtained by subjecting a conjugate filament, which comprises polybutylene terephthalate and polyethylene terephthalate having an intrinsic viscosity of 0.55 or less in a side-by-side or eccentric sheath-core arrangement, to single heater false twisting processing under the conditions within the range specified above.

The number of false twists TW (T/m) at the time of false twisting must be adjusted depending upon the total denier of the yarn to be false twisted and a false twisted yarn having a degree of crimpability $TC_{10}$ of 8% or more, preferably 25% at the most, can be obtained by setting the number of false twists TW at $24380/\sqrt{De}$ (T/m) or more, preferably at $29250/\sqrt{De}$ (T/m) or more. Though no specific limit exists as to the maximum number of false twists, it is desirable to set it at $39000/\sqrt{De}$ (T/m) or less, taking the stability of false twisting processing, including the prevention of both fluffing of the processed yarn and breakage during the process the strength at break of the processed yarn, etc., into consideration.

Figure 3:
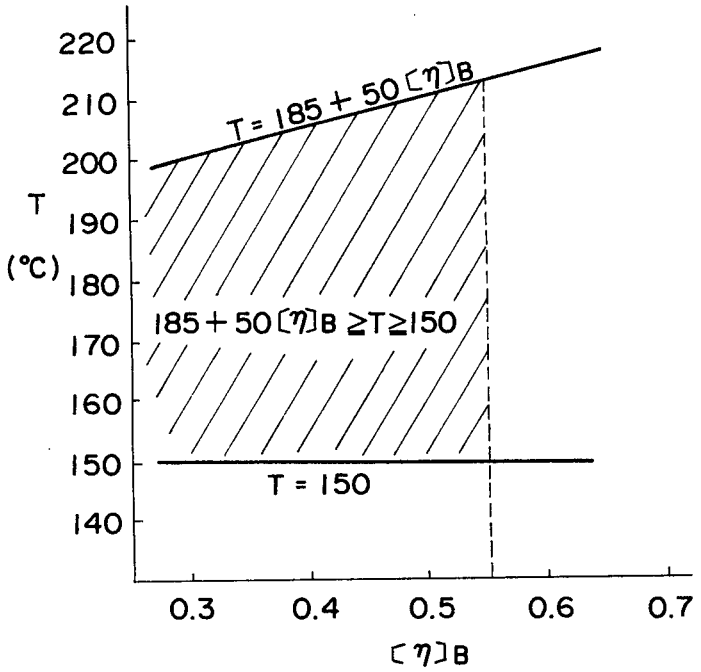
FIG. 3 is a graph to show the relationship between the intrinsic viscosity $[\eta]B$ of the yarn component used to produce the crimped yarns of the present invention and the proper temperature T in °C. of the false twister heater.

FIG. 3 clearly shows that the temperature of the false twister heater should be maintained within the range of about 150° C. or higher, preferably 170° C. or higher, and a temperature calculated from the relationship $185+50[\eta]B$ or lower. If the temperature of the false twister heater is lower than about 150° C., a filament having a degree of crimpability $TC_{10}$ of 8% or more cannot be obtained.

Also, when the temperature is higher than the value calculated from the relationship $185+50[\eta]B$, the orientation effect of the molecules of polyethylene terephthalate of the B component cannot be achieved fully due to the influence of polybutylene terephthalate of the A component, and accordingly filaments having tight spots are found after the false twisting process. Thus, it is impossible to obtain a filament having a degree of crimpability $TC_{10}$ of 8% or more.

As for the false twister, any of the spindle false twisters, friction false twisters, fluid false twisters, etc., can be used.

The present invention is particularly advantageous when the value ($TC_{10}\sqrt{De}$) obtained by multiplying the degree of crimpability $TC_{10}$ by the square root of the total denier De of the yarn before it is subjected to the boiling water shrinking treatment is 85 or more, preferably 300 at most.

The fact that $TC_{10}\sqrt{De}$ is 85 or more means that when the total denier of a yarn is smaller, a higher $TC_{10}$ is required for the yarn. While not presently completely understood and while not desiring to be bound, the following explanation is presented. The stretchability of a woven fabric, which is made of a yarn whose polymer itself is tough and stiff, unlike those yarns made of rubber, polyurethane, etc., having a high degree of stretchability, varies depending upon the conformation of the yarns in the fabric. In a woven fabric, for instance, when the weft yarns are stretched, the wavy degree of slack of the weft yarns is straightened, causing at the same time the upper or surface weft yarns to shift further upward and the lower or reverse weft yarns to shift further downward. In this way, the weft yarns which are made structurally wavy in the woven fabric are stretched into a condition where they are straight. The stretchability of a woven fabric made of a polyester yarn whose polymer is tough and stiff is mostly determined by the extent of the wavy degree of slack of each filament which forms the yarn from which the woven fabric is constructed and also by the degree of waviness of the whole yarns in the woven fabric construction. When woven fabrics are of the same construction, the degrees of stretchability of the respective woven fabrics differ from each other depending upon the degrees of slack in the filaments of yarns used to construct the woven yarn. Of course, the larger the degree of slack, the higher the degree of stretchability.

Therefore, to increase the stretchability of a woven fabric, it is necessary to increase the percentage crimp of the yarn in the processes of relaxing and dyeing the woven fabric. To achieve this object, it is desirable to increase the percentage crimp by raising the $TC_{10}$ and to minimize the frictional binding force between the yarns or between the filaments in the yarn so that the respective yarns or filaments in the yarn are allowed to slip freely. However, when the number of the total denier of a yarn decreases, the binding force working on the yarn increases at a ratio of 1:2 (the reciprocal of the ratio of denier decrease). Therefore, a higher $TC_{10}$ is required as the number of the total denier of the yarn decreases and the proper balance is acquired by the value of $TC_{10}\sqrt{De}$ which is one of the factors involved in the present invention.

As explained in detail in the above, the conjugate crimped yarn of the present invention thus obtained has a degree of crimpability $TC_{10}$ of 8% or more when it is subjected to a boiling water treatment under a high load, i.e., under a load of 10 mg/de. A woven fabric prepared from this crimped yarn has a stretch percentage of 15% or more to give a very good stretch woven fabric. Though no specific limit exists as to the maximum stretch percentage, it is desirable to be 25% or less for plain fabrics and 50% or less for twill fabrics. Furthermore, in the preparation of the polyester conjugate crimped yarn of the present invention, the yarn is subjected directly to a tension heat setting treatment under a false twisting tension without going through the high relaxation treatment conducted in a high temperature atmosphere which is adopted in the conventional heat treatment for making a conjugate yarn crimpable. Accordingly, a stretch woven fabric prepared from each yarn is completely free from the problems of dyeing specks resulting from an uneven heat setting of the yarn or the formation of tight picks in the woven fabric arising from the high relaxation treatment.

The cause for the high degree of crimpability of the polyester conjugate yarn of the present invention has not yet been clarified sufficiently but it is assumed to be attributable to the following.

When a conjugate filament is obtained by melt spinning the A component comprising polybutylene terephthalate and the B component comprising polyethylene terephthalate in a side-by-side or eccentric sheath-core arrangement, the molecular orientation of the A component of the thus-obtained filament is high in comparison with that of the B component. In the succeeding processes in which the conjugate spun filament is drawn and false twisted separately or simultaneously, the A component of a filament mostly tends to be positioned toward the inside of the twisted yarn, because the A component, whose molecular orientation is comparatively high, is less elongated than the B component. Therefore, the A component receives less heat from the heater in comparison with the B component. Furthermore, since the polybutylene terephthalate A component requires a large amount of time for the relaxation of thermal stress imposed by the tension heat-setting in comparison with the polyethylene terephthalate of the B component, the A component has a large amount of residual shrinkage stress in comparison with that of the B component. It is, therefore, assumed that after the twisting process the filament begins delicately to gather its potential power to resume its twisted or stretched state and a high degree of crimpability arises. Based on this assumption, the point which must be noted most carefully in the present invention is the heat settability of the polyethylene terephthalate B component. Specifically, reducing the shrinkage stress of the polyethylene terephthalate B component to the minimum degree at a certain temperature while maintaining the shrinkage stress of the polybutylene terephthalate A component at a maximum degree at the same temperature is important. As a means for achieving this object, it has been found that the reduction of the intrinsic viscosity [η]B of the polyethylene terephthalate B component is very useful and thus the preparation of a crimped yarn having a degree of crimpability $TC_{10}$ of 8% or more when subjected to a boiling water treatment under a load of 10 mg/de, which is a characteristic aspect of the present invention, by false twisting polyester conjugate filaments whose intrinsic viscosity [η]B is 0.55 or less is possible.

The degree of crimpability $TC_{10}$ obtained while subjecting the yarn to a boiling water treatment under a load of 10 mg/de, the intrinsic viscosity [η]A and [η]B of the components A and B of the melt spun filament, the total denier De of the yarn after the false twisting process, and the stretch percentage of the woven fabric in the present invention are determined respectively according to the following methods.

(1) Degree of Crimpability $TC_{10}$ obtained at the time of a boiling water treatment under a load of 10 mg/de:

A sample of stretch yarn 3 or more days after production is wound on a reel under a tension of 50 mg/de to obtain a skein of about 3000 denier. A load of 2 mg/de+200 mg/de is attached to one end of thus obtained skein, and the length $l_o$ (cm) of the sample is measured. Then the load of 200 mg/de is replaced with a load of 8 mg/de, thus making a total load of 10 mg/de. The sample is then treated under this condition in boiling water at 100° C. for 20 minutes. After the boiling water treatment, all the load is removed immediately and the sample is dried naturally (at room temperature) under a free state for 24 hours. A load of 2 mg/de+200 mg/de is again attached to the thus naturally dried sample and 1 minute later the length of the sample $l_1$ (cm), is measured. Then the load of 200 mg/de is removed and 1 minute later the length $l_2$ is measured. The degree of crimpability $TC_{10}$ is calculated from the following equation:

$$TC_{10}(\%)=(l_1-l_2)/l_o$$

(2) Intrinsic Viscosity [η]A and [η]B of the components A and B:

The intrinsic viscosity is determined with samples prepared from components A and B, respectively, obtained separately by extrusion under the same conditions of melt spinning the conjugate filament. The determination is carried out using an ortho-chlorophenol solution at 35° C.

(3) Total Denier of the Yarn after the false twisting process:

90 m of a sample is wound on a reel under a tension of 100 mg/de. The weight of the sample is measured and converted into denier.

(4) Stretch Percentage of the woven fabric:

A sample is prepared by cutting a fabric weftwise, 30 cm in length and 5 cm in width, and two points are marked, each point 100 mm apart lengthwise from the center of the sample (the distance between the two points being 200 mm). One end of the sample is held firmly with a 60 mm wide chuck and a load of 1.5 kg is attached to the other end. The sample is left hanging for 5 seconds and the length L (mm) of the sample between the two marked points is measured. The stretch percentage is calculated from the following equation:

$$\text{Stretch Percentage (\%)} = \frac{L-200}{200} \times 100.$$

(5) Appearance Quality of the woven fabric:

The appearance is judged and graded on a scale of 1 to 5 by looking at the woven fabric sample from above. Grades 1 to 3 are unsatisfactory and grades 4 and 5 are satisfactory.

The present invention is described in greater detail by reference to the following examples.

EXAMPLE 1

Conjugate filaments of an A component comprising polybutylene terephthalate which contained 0.3% by weight of titanium oxide and which had an intrinsic viscosity of 0.86 and a B component comprising four kinds of polyethylene terephthalate whose intrinsic viscosities were respectively, 0.64, 0.57, 0.47, and 0.37 containing 0.3% by weight of titanium oxide were melt spun using a spinneret which had 48 pairs of extrusion orifices and was designed according to Japanese Patent Publication No. 19108/68, and set on a commercially available conjugate spinning machine. Both A and B components were extruded at an extrusion ratio of 50:50 by weight in a side-by-side arrangement. The conjugate filaments were wound up at varied take-up rates of 1500 m/min., 2500 m/min., and 3000 m/min. The extrusion rate was adjusted so that the total denier of the yarn after false twisting was 150 denier.

Furthermore, conjugate filaments, which were wound up at a take-up rate of 1200 m/min., were drawn using a commercially available single stage drawing machine in such a way that an elongation at break of 30% after the filaments had been drawn was obtained.

The conjugate filaments prepared as described above were then subjected to false twisting with the use of a commercially available spindle false twister of a single heater type by varying the temperature of the heater and the number of false twists to obtain polyester conjugate crimped yarns. The false twisting was conducted at a rate of 120 m/min. and the ratio between the supplying rate and the taking-up rate was adjusted to an elongation at break of the yarn after false twisting of approximately 25%.

A plain weave fabric having a warp density of 26.5 yarns/cm and a weft density of 25.9 yarns/cm was prepared by using a commercially available single heater false twisted polyester yarn, 150 denier/48 filaments, as a warp yarn and the crimped yarn prepared as described above as the weft yarn using an ordinary commercially available weaving machine.

The prepared plain weave was subjected to a series of processes in the order of a relaxation treatment in boiling water at 100° C. for 40 minutes, presetting in heated air at 180° C. for 45 seconds, dyeing in a dye liquor at 130° C. for 45 minutes, and final setting in a heated air stream at 160° C. for 45 seconds, to obtain a woven fabric whose stretch percentage was measured. The results are shown in Table 1 below:

TABLE 1

| Run No. | Intrinsic Viscosity of B Component [η]B | Take Up Rate (m/min) | Temperature of False Twister Heater (°C.) | Number of False Twists (T/m) | False Twistability | Degree of Crimpability $TC_{10}$ (%) | Stretch Percentage of Woven Fabric (%) | Appearance Quality of Woven Fabric |
|---|---|---|---|---|---|---|---|---|
| *1 | 0.61 | 1500 | 190 | 2650 | Good | 6.2 | 10.8 | Satisfactory |
| *2 | " | 2500 | " | " | " | 6.6 | 12.4 | " |
| *3 | " | 3000 | " | " | " | 7.8 | 14.0 | " |
| *4 | " | " | 210 | " | " | 7.4 | 14.0 | " |
| *5 | " | " | 220 | " | Tight spot present | 5.0 | 9.8 | Unsatisfactory |
| *6 | 0.54 | 1500 | 140 | " | Good | 7.2 | 13.4 | Satisfactory |
| *7 | " | " | 150 | 1900 | " | 7.0 | 13.0 | " |
| 8 | " | " | " | 2000 | " | 8.2 | 15.6 | " |
| 9 | " | " | " | 2400 | " | 8.6 | 16.0 | " |
| 10 | " | " | " | 2650 | " | 8.6 | 15.8 | " |
| 11 | " | " | 170 | " | " | 10.2 | 18.0 | " |
| 12 | " | " | 190 | " | " | 12.0 | 20.4 | " |
| 13 | " | " | 210 | " | " | 10.8 | 18.8 | " |
| *14 | " | " | 215 | " | Tight spot present | 6.8 | 13.2 | Unsatisfactory |
| *15 | " | 2500 | 140 | 2650 | Good | 7.4 | 13.8 | Satisfactory |
| 16 | " | " | 150 | " | " | 8.2 | 16.6 | " |
| 17 | " | " | 190 | " | " | 13.4 | 23.4 | " |
| 18 | " | " | 210 | " | " | 9.8 | 16.8 | " |
| *19 | " | " | 215 | " | Tight spot present | 6.4 | 13.2 | Unsatisfactory |
| *20 | " | 3000 | 140 | " | Good | 6.8 | 11.6 | Satisfactory |
| 21 | " | " | 150 | " | " | 9.2 | 16.4 | " |
| 22 | " | " | 190 | " | " | 15.8 | 26.2 | " |
| 23 | " | " | 210 | " | " | 11.0 | 19.4 | " |
| *24 | " | " | 215 | " | Tight spot present | 7.2 | 13.4 | Unsatisfactory |
| *25 | 0.45 | 2500 | 140 | " | Good | 7.0 | 12.6 | Satisfactory |
| 26 | " | " | 150 | " | " | 8.6 | 16.0 | " |
| 27 | " | " | 190 | " | " | 16.2 | 26.0 | " |
| 28 | " | " | 205 | " | " | 13.8 | 23.8 | " |
| *29 | " | " | 210 | " | Tight spot present | 6.6 | 11.0 | " |
| *30 | 0.35 | 2500 | 140 | " | Good | 7.6 | 14.2 | Unsatisfactory |
| 31 | " | " | 150 | " | " | 9.2 | 16.0 | Satisfactory |
| 32 | " | " | 190 | " | " | 17.8 | 28.2 | " |
| 33 | " | " | 200 | " | " | 15.4 | 25.6 | " |
| *34 | " | " | 205 | " | Tight spot present | 6.8 | 14.4 | Unsatisfactory |

Note:
*Control. The same note is applicable to succeeding Tables 2, 3, and 4.

With regard to Run Nos. 1 to 5 in Table 1, the respective yarns which compose these samples fail to have sufficient heat setting effect in the false twisting process and more of them exhibit a degree of strechtability $TC_{10}$ of 8% or more. Accordingly, the elongation percentage of the woven fabric is less than 15% and they are unsatisfactory as a stretch woven fabric. This is because the intrinsic viscosity [η]B of the B component is more than 0.55 and does not satisfy the conditions of the preparation process of the present invention.

Run Nos. 6, 15, 20, 25, and 30 show that none of the yarns used in the making of the samples have a degree of stretchability $TC_{10}$ of 8% or more and all of the woven fabric samples exhibit an elongation percentage of less than 15%. This is because the temperature of the heater is too low to satisfy the conditions of false twisting provided for the preparation process of the present invention. Run Nos. 14, 19, 24, 29, and 34 show that the stretched yarns which compose the samples are partially not twisted and the degree of stretchability $TC_{10}$ is less than 8%, thus making the elongation percentage of the woven fabric less than 15%. This is because the temperature of the heater is too high to satisfy the conditions of false twisting providing for the process of the present invention.

It is clear from the results obtained in this example that all the polyester conjugate stretch yarns having a degree of stretchability $TC_{10}$ of 8% or more when treated with boiling water under a load of 10 mg/de according to the present invention are useful in producing a stretch woven fabric having an elongation percentage of 15% or more. The evaluation conducted by five skilled textile experts as to the appearance quality of the woven fabrics, including luster, dyeing specks, formation of tight picks in the woven fabric, pleasing bulkiness, etc., showed that all the samples provided good results, with the exception of Run Nos. 5, 14, 19, 24, 29, and 34 whose lack of pleasing bulkiness was noted.

It is apparent from the above example that the polyester conjugate crimped yarn of the present invention has a high degree of crimpability when treated in boiling water under a high load and accordingly it is possible to provide a woven fabric of high stretchability with ease and at low cost. The advantage provided by the present invention is not limited only to fabrics with high stretchability. Since the polyester conjugate crimped yarn prepared according to the present invention is subjected to false twisting, problems of dyeing specks and tension difference of the yarns in woven fabrics produced with conventional polyester conjugate crimped yarns are solved and the present invention provides a stretch woven fabric of high marketability.

Mention can also be made as to the polyester conjugate crimped yarn of the present invention that it also finds use in the preparation of knitted lace curtains and other interior decoration materials in addition to woven fabrics.

Also polyester conjugate crimped yarns prepared according to the present invention do not lose the characteristics of the present invention even when they are used in a state of where they are not substantially twisted or are twisted.

Furthermore, polyester conjugate crimped yarns of the present invention can be used together with other fiber materials such as polyester textured yarns, polyester flat yarns, nylon textured yarns, nylon flat yarns, cotton yarns, etc., if so desired.

EXAMPLE 2

A crimped yarn in which components A and B of the conjugate filaments were arranged in a side-by-side relationship was prepared according to the procedures of Example 1, except that the B component comprised polyethylene terephthalate having an intrinsic viscosity of 0.47 and that the extrusion ratio between the A component and B component was varied.

The results are shown in Table 2 below:

TABLE 2

| Run No. | Extrusion Ratio A | Extrusion Ratio B | Spinning and Take Up Rate (m/min) | Temperature of False Twister Heater (°C.) | Number of False Twists (T/m) | False Twist-ability | Degree of Crimpability $TC_{10}$ (%) | Stretch Percentage of Fabric (%) | Appearance Quality of Fabric | Remarks |
|---|---|---|---|---|---|---|---|---|---|---|
| *35 | 25 | 75 | — | — | — | — | — | — | — | Not spinnable |
| 36 | 30 | 70 | 2500 | 190 | 2650 | Good | 12.3 | 20.4 | Good | |
| 37 | 35 | 65 | " | " | " | " | 15.2 | 25.4 | " | |
| 38 | 40 | 60 | " | " | " | " | 16.0 | 26.3 | " | |
| 39 | 60 | 40 | " | " | " | " | 16.3 | 27.5 | " | |
| 40 | 65 | 35 | " | " | " | " | 13.9 | 23.9 | " | |
| *41 | 75 | 25 | — | — | — | — | — | — | — | Not spinnable |

Where the extrusion ratio of either A component or B component approaches 30% by weight, polymers leaving the spinneret at the time of melt spinning start bending, degrading the spinnability. When the ratio is less than 30% by weight, bending occurs more extremely and extruded polymers stick to the spinneret making it impossible to continue spinning or the extruded polymers start rotating and the size or denier of filament becomes uneven, causing filament breakage at the time of drawing, thus substantially damaging the filaments to too great an extent for use as a fiber material (Run Nos. 35 and 41).

For spinning filaments or yarn, in which the ratio of either the A component or the B component is below 30% by weight, it is advisable to use a spinneret of an eccentric sheath-core type which causes the polymers to join together before they are extruded from the spinneret. The use of a spinneret of this type for spinning such filaments reduces difficulties observed with a spinneret of the side-by-side type.

A crimped yarn in which the components A and B of the conjugate filaments are arranged in an eccentric sheath-core relationship was prepared according to the procedures of Example 1, using a spinneret described in Japanese Patent Publication No. 16125/66, except that the B component comprised polyethylene terephthalate having an intrinsic viscosity of 0.47 and that the extrusion ratio between the A component and B component was varied.

The results are shown in Table 3 below.

TABLE 3

| Run No. | Extrusion Ratio A | Extrusion Ratio B | Spinning and Take Up Rate (m/min) | Temperature of False Twister Heater (°C.) | Number of False Twists (T/m) | False Twist-ability | Degree of Crimpability $TC_{10}$ (%) | Stretch Percentage of Fabric (%) | Appearance Quality of Fabric |
|---|---|---|---|---|---|---|---|---|---|
| *42 | 25 | 75 | 2500 | 190 | 2650 | Good | 6.5 | 12.3 | Satisfactory |
| 43 | 30 | 70 | " | " | " | " | 8.0 | 15.1 | " |
| 44 | 35 | 65 | " | " | " | " | 10.1 | 17.3 | " |
| 45 | 40 | 60 | " | " | " | " | 11.3 | 19.2 | " |
| 46 | 60 | 40 | " | " | " | " | 12.6 | 19.8 | " |
| 47 | 65 | 35 | " | " | " | " | 9.9 | 17.7 | " |
| *48 | 75 | 25 | " | " | " | " | 7.5 | 13.2 | " |

In Table 3, both Run Nos. 42 and 48 show that the weight ratio between the A component and B component is outside the range of 30:70 to 70:30% by weight. Therefore, the degree of crimpability $TC_{10}$ does not exceed 8%. Further, the stretch percentage of a woven fabric prepared from the yarns does not exceed, either. This shows that the fabric is not satisfactory for use as a stretch woven fabric. On the other hand, when the weight ratio between the A component and B component is in the range of 30:70 to 70:30% by weight (Run Nos. 36 to 40 and 43 to 47), the degree of crimpability $TC_{10}$ exceeds 8% and the stretch percentage of the fabric was more than 15%. The fabric is sufficiently satisfactory for use as a stretch woven fabric.

EXAMPLE 3

An undrawn conjugate yarn of 200 denier/48 filaments having a degree of elongation at break of 105% was obtained by extruding polyethylene terephthalate, which had an intrinsic viscosity of 0.64 and contained 0.3% by weight of titanium oxide, and polybutylene terephthalate, which had an intrinsic viscosity of 0.87 and contained 0.25% by weight of titanium oxide, respectively, melted at 300° C. and 270° C., at an extrusion ratio of 50:50 by weight using a spinneret with 48 pairs of orifices designed according to Japanese Patent Publication No. 19108/68, and by taking up the conjugate filaments cross-sectionally composed in a side-by-side arrangement at a rate of 3200 m/min. while applying oil to the filaments.

The obtained undrawn conjugate yarn was false twisted using a false twister, CS-12-600 model, manufactured by Earnest Scrag Corp., at a supplying rate of 83 m/min. and a taking up rate of 115 m/min., while varying the temperature of the heater, to produce crimped yarns. The results are described in Table 4 below.

TABLE 4

| Run No. | Number of False Twists (T/m) | Temperature of Heater (°C.) | Total Denier (De) | $TC_{10}$ (%) | $TC_{10}\sqrt{De}$ | Stretch Percentage of Fabric (%) |
|---|---|---|---|---|---|---|
| 49 | 2250 | 180 | 149 | 5.2 | 63 | 16.5 |
| 50 | " | 200 | 148 | 6.5 | 79 | 19.0 |
| 51 | " | 220** | " | 3.2 | 39 | 9.5 |
| 52 | 2500 | 180 | 149 | 5.5 | 67 | 16.6 |
| 53 | " | 200 | " | 8.4 | 102 | 22.3 |
| 54 | 2750 | 180 | " | 6.1 | 74 | 17.5 |
| 55 | " | 200 | 148 | 8.9 | 108 | 23.8 |
| 56 | 3000 | 180 | " | 6.2 | 75 | 17.4 |
| 57 | " | 200 | " | 9.1 | 111 | 23.3 |

**Partially not twisted

Also grey fabrics of a plain weave having a warp density of 26.4 yarns/cm and a weft density of 25.9 yarns/cm were prepared from the crimpled yarns shown in Table 4 above using an ordinary commerically available weaving machine, wherein commercially available one-heater false twisted polyethylene terephthalate yarns of 150 de/48 filaments were used as warp yarns and yarns of Run No. 49 to Run No. 57 as weft yarns respectively. The thus prepared grey fabrics were subjected to the following processing in the order listed: relaxation scouring at 100° C. for 20 minutes, presetting at 160° C. for 1 minute, high pressure dyeing at 130° C. for 60 minutes and final setting at 160° C. for 1 minute to obtain stretch woven fabrics. The stretch percentage of these stretch woven fabrics was measured weftwise and the results are also shown in Table 4 above.

The stretch woven fabrics made from the crimped yarns which satisfy $TC_{10}$ and $TC_{10}\rightleftarrows de$ values of the present invention not only had a high stretch percentage but also had excellent bulky feel, resiliency, and luster.

While the invention has been described in detail herein, it will be apparent that modifications and variations can be made therein without departing from the spirit and scope thereof.

We claim:

1. Polyester conjugate crimped yarns comprising yarns produced by conjugate spinning (a) an A component substantially comprising polybutylene terephthalate and (b) a B component substantially comprising polyethylene terephthalate and having an intrinsic viscosity $[\eta]B$ of 0.55 or less at a weight ratio of A component to B component of 30:70 to 70:30 in a side-by-side or eccentric sheath-core arrangement, rendered crimpable by false twisting to a degree of crimpability $TC_{10}$ of 8% or more when subjected to a boiling water treatment under a load of 10 mg/de.

2. Polyester conjugate crimped yarns according to claim 1, wherein the yarns have the degree of crimpability $TC_{10}$ of 10% or more.

3. Polyester conjugate crimped yarns according to claim 1 or claim 2, wherein the yarns have a value ($TC_{10}\sqrt{De}$) of 85 or more, obtained by multiplying the degree of crimpability $TC_{10}$ by the square root of the total denier De of the yarn prior to the boiling water treatment.

4. Polyester conjugate crimped yarns as claimed in claim 1, wherein the A component has an intrinsic viscosity $[\eta]A$ of 0.7 or more.

* * * * *